US006237669B1

(12) United States Patent
Ko

(10) Patent No.: US 6,237,669 B1
(45) Date of Patent: May 29, 2001

(54) TILT CORD CONTROLLER FOR VENETIAN BLINDS

(76) Inventor: Kuentin Ko, 19F-1, No. 211, Jong Jeng 4th Rd., Kaohsiung City (TW)

( * ) Notice: Subject to any disclaimer, the term of this patent is extended or adjusted under 35 U.S.C. 154(b) by 0 days.

(21) Appl. No.: 09/618,836

(22) Filed: Jul. 18, 2000

(51) Int. Cl.[7] ..... E06B 9/38
(52) U.S. Cl. ..... 160/177 V; 160/319
(58) Field of Search ..... 160/177 V, 176.1 V, 160/176.1 R, 177 R, 172 V, 173 V, 168.1 V, 168.1 R, 900, 319, 321

(56) References Cited

U.S. PATENT DOCUMENTS 4,224,973 * 9/1980 Hugin ..... 160/176.1 V X
4,836,345 * 6/1989 Anderson ..... 160/176.1 V X
5,293,921 * 3/1994 Marocco ..... 160/177 R X
5,636,677 * 6/1997 Liu ..... 160/177 R

* cited by examiner

*Primary Examiner*—David M. Purol
(74) *Attorney, Agent, or Firm*—Rosenberg, Klein & Lee

(57) ABSTRACT

A tilt cord controller includes a casing, a rotating member rotatably mounted in the casing, and an axle including a first end with an end face and a second end. The second end of the axle is securely engaged with the rotating member to rotate therewith. The end face of the first end of the axle includes a slit such that the first end of the axle is compressible inward. The end face of the first end of the axle further includes a receptacle for receiving a bumping member. A pulley is mounted around the first end of the axle to rotate therewith. A tilt cord is mound around the pulley. When an excessive force is applied to the tilt cord, the first end of the axle is compressed inward to avoid damage to the transmission elements.

4 Claims, 6 Drawing Sheets

TILT CORD CONTROLLER FOR VENETIAN BLINDS

BACKGROUND OF THE INVENTION

1. Field of the Invention

The present invention relates to a tilt cord controller for venetian blinds, e.g., vertical venetian blinds, for preventing damage to transmission elements due to excessive pulling force acting on the tilt cord.

2. Description of the Related Art

FIG. 1 of the drawings illustrates a tilt cord controller for venetian blinds for controlling tilt angle of the blind. The tilt cord controller includes a casing 21 consisting of two casing halves 211 and 212, wherein casing half 212 includes a tubular member 213 for rotatably holding a rotating member 214, and casing half 211 is used to rotatably support a pulley 22 around which a tilt cord (not shown) is wound around. The pulley 22 includes a stud 221 with annularly spaced longitudinal ridges 222 formed on an outer periphery of the stud 221. The rotating member 214 includes a plurality of annularly spaced grooves (not shown) in an inner periphery defining a longitudinal hole 215 thereof for securely engaging with the ridges 222. Thus, pulling of the tilt cord causes rotation of the pulley 22, which, in turn, drives the tilt rod (not shown) via transmission by the rotating member 214. Nevertheless, it is found that the pulley 22 and the rotating member 214 and other transmission elements are damaged easily if the tilt colt is pulled by an excessive force which still forces the tilt rod to turn although the tilt rod has reached its end position. Longevity of the tilt cord controller is thus shortened.

SUMMARY OF THE INVENTION

It is the primary object of the present invention to provide a tilt cord controller for venetian blinds for preventing damage to transmission elements due to excessive pulling force acting on the pull cord, thereby preventing shortening of longevity of the tilt cord controller.

A tilt cord controller in accordance with the present invention comprises:

a casing;

a rotating member rotatably mounted in the casing;

an axle including a first end with an end face and a second end, the second end of the axle being securely engaged with the rotating member to rotate therewith, the end face of the first end of the axle including a slit such that the first end of the axle is compressible inward, the end face of the first end of the axle further including a receptacle;

a bumping member mounted in the receptacle of the first end of the axle;

a pulley mounted around the first end of the axle to rotate therewith; and a tilt cord mound around the pulley.

The first end and the second end of the axle have different diameters to form a step therebetween. The bumping member is a spring or made from rubber.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
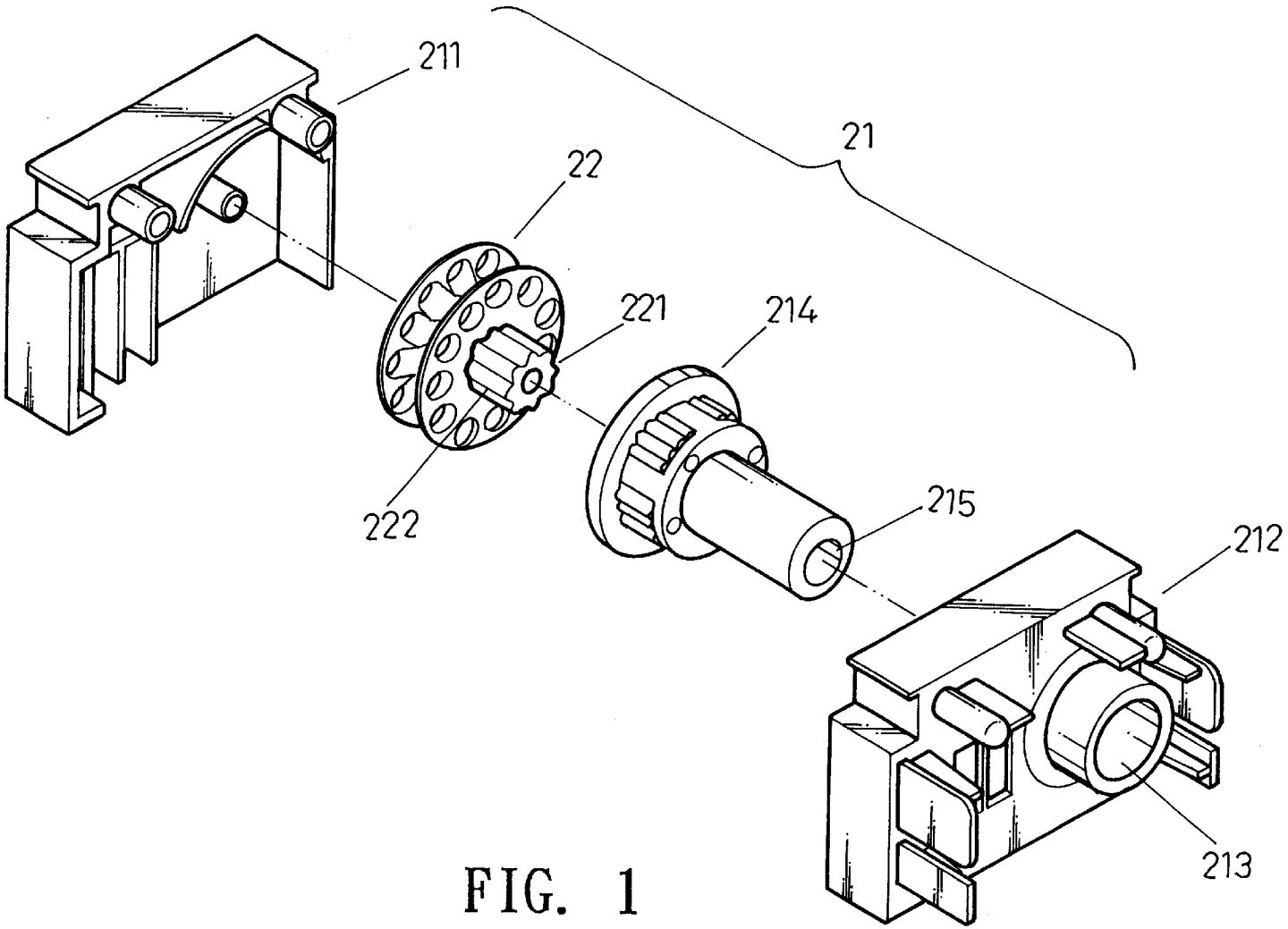
FIG. 1 (PRIOR ART)
FIG. 1 is an exploded perspective view of a conventional tilt cord controller.
Figure 2:
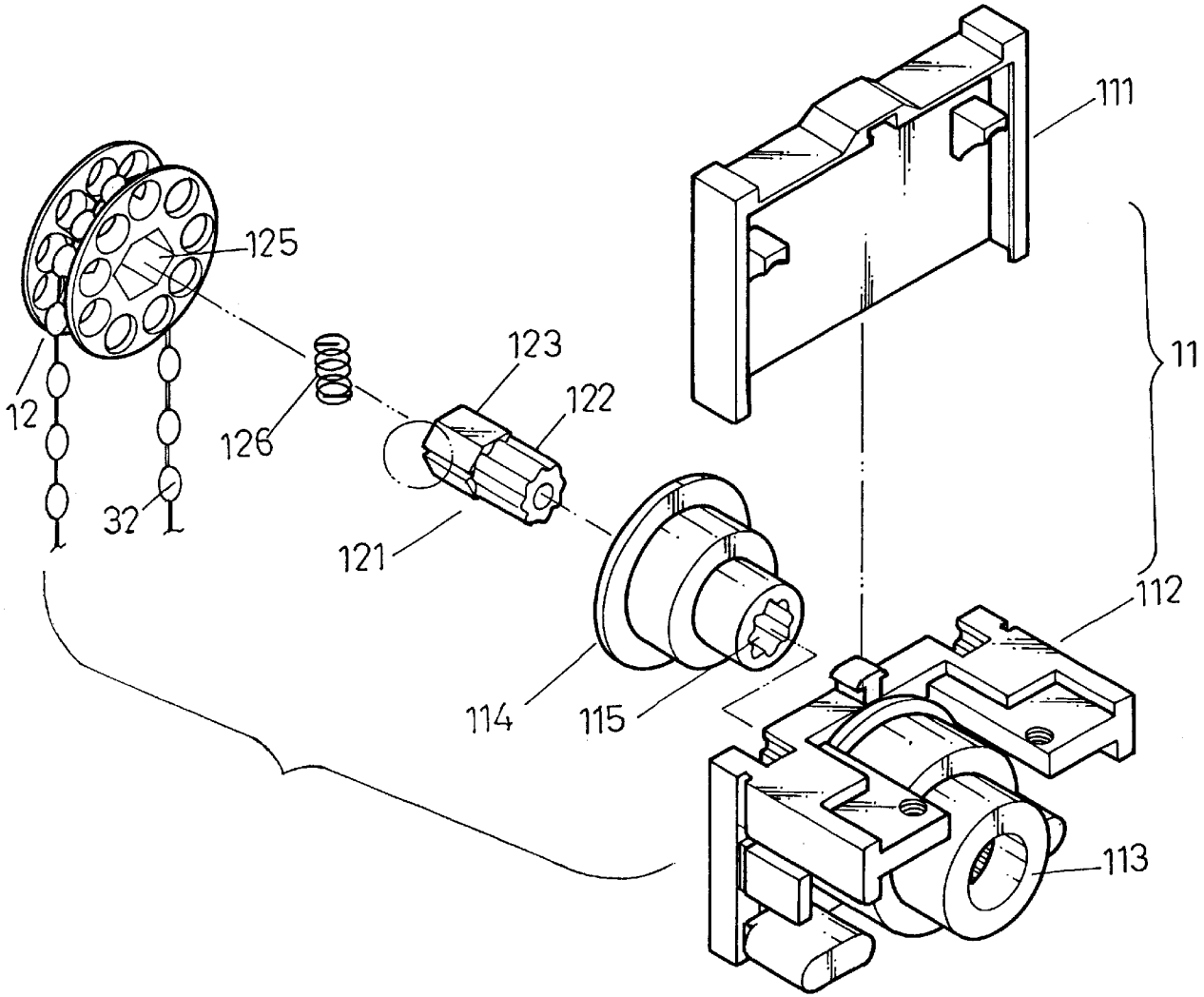
FIG. 2 is an exploded perspective view of a tilt cord controller in accordance with the present invention.
Figure 2A:
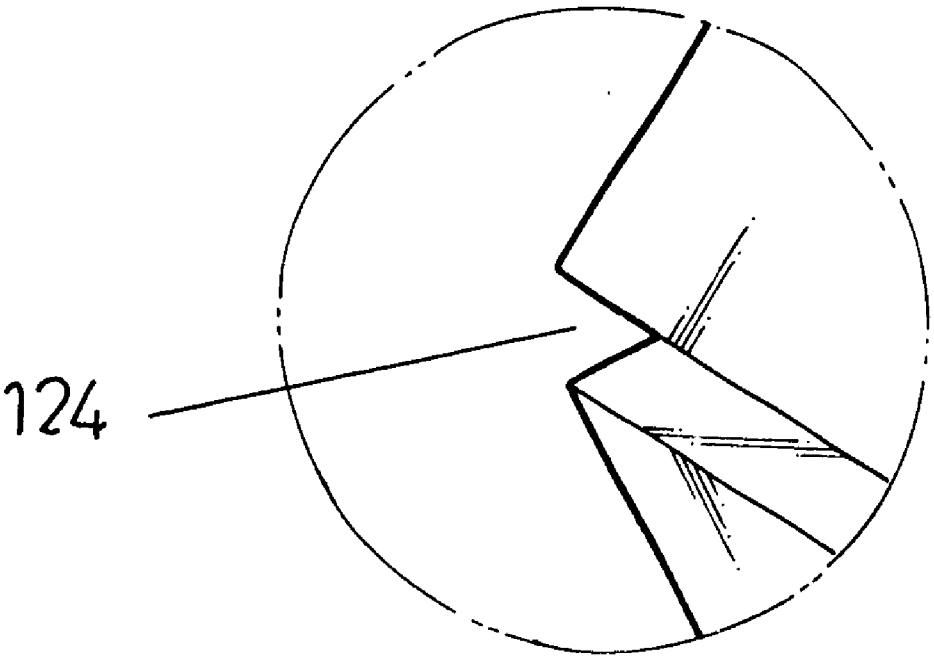
FIG. 2A is an enlarged view of a circle in FIG. 2.
Figure 4:
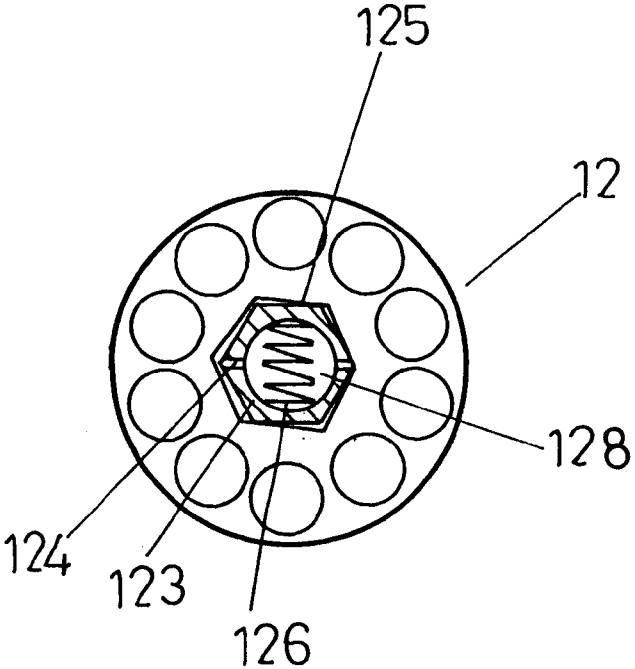
FIG. 4 is a side view similar to FIG. 3, illustrating operation of the tilt cord controller.

Referring to FIG. 2, a tilt cord controller in accordance with the present invention generally includes a casing 11 consisting of two casing halves 111 and 112. The casing half 112 includes a tubular member 113 for rotatably holding a rotating member 114. The rotating member 114 includes a longitudinal hole 115 having a plurality of annularly spaced grooves (not labeled) in an inner periphery thereof. An axle 121 includes a first end 123 and a second end 122 that has annularly spaced longitudinal ridges (not labeled) formed on an outer periphery thereof for securely engaging with the grooves of the rotating member 114, thereby allowing joint rotation of the axle 121 and the rotating member 114. The first end 123 and the second end 122 of the axle 121 may have different diameters to form a step therebetween.

Figure 3:
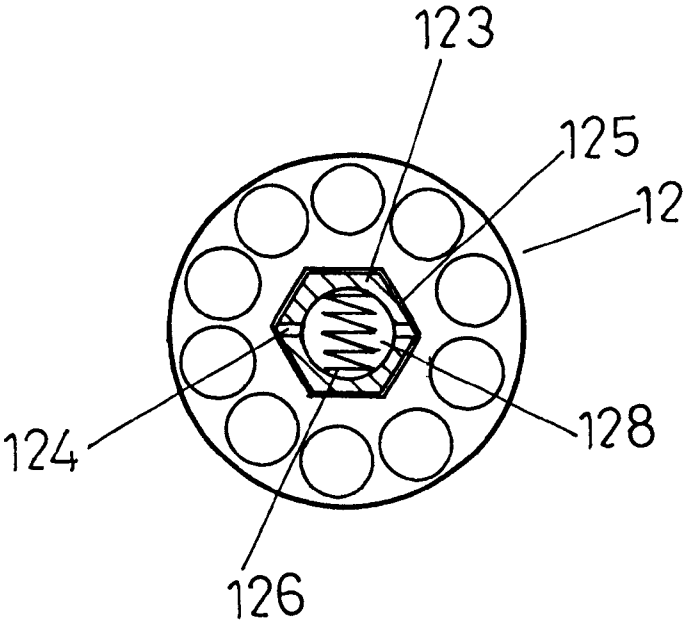
FIG. 3 is a side view of the tilt cord controller in accordance with the present invention, wherein the casing is removed for clarity.
Figure 7:
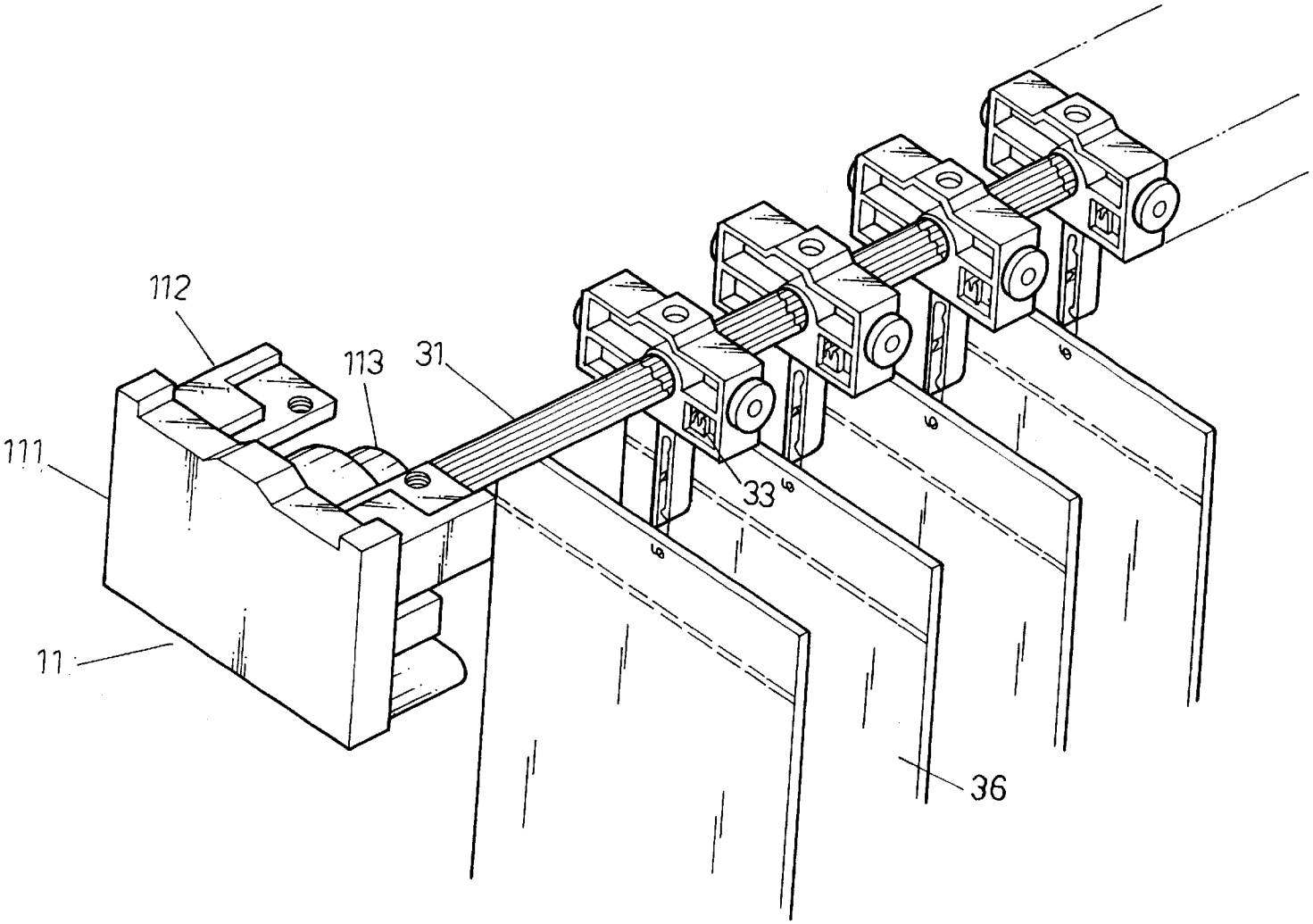
FIG. 7 is a perspective view illustrating use of the tilt cord controller in accordance with the present invention on a vertical venetian blind.

Mounted around the first end 123 of the axle 121 is a pulley 12 around which a tilt cord 32 is wound. In this embodiment, the pulley 12 includes a polygonal central hole 125 for engaging with the first end 123 of the axle 121 which has a polygonal outer periphery (not labeled). As illustrated in FIG. 3, an end face of the first end 123 of the axle 121 includes a receptacle 128 and a slit 124. The slit 124 allows the first end 123 of the axle 121 to be compressed inward. Mounted in the receptacle 128 is a bumping member, such as a spring 126. By such an arrangement, when the tilt cord 32 is pulled, the tilt rod 31 is rotated, which, in turn, causes rotation of the vertical strips 36 (FIG. 7) of a vertical venetian blind via transmission of the pulley 12, the axle 121, the rotating member 114, and a rack 33 (FIG. 7), which is conventional and therefore not described in detail. Of more importance, when the rack 33 has reached its end position while the user still apply force to the tilt cord 32, the first end 123 of the axle 121 is compressed inward due to provision of the slit 124. The spring 126 in the receptacle 128 of the first end 123 of the axle 121 absorbs the excessive torque from the tilt cord 32, thereby preventing damage to the transmission elements. The first end 123 is returned to its original shape by the spring 126 after the excessive force is released.

Figure 6:
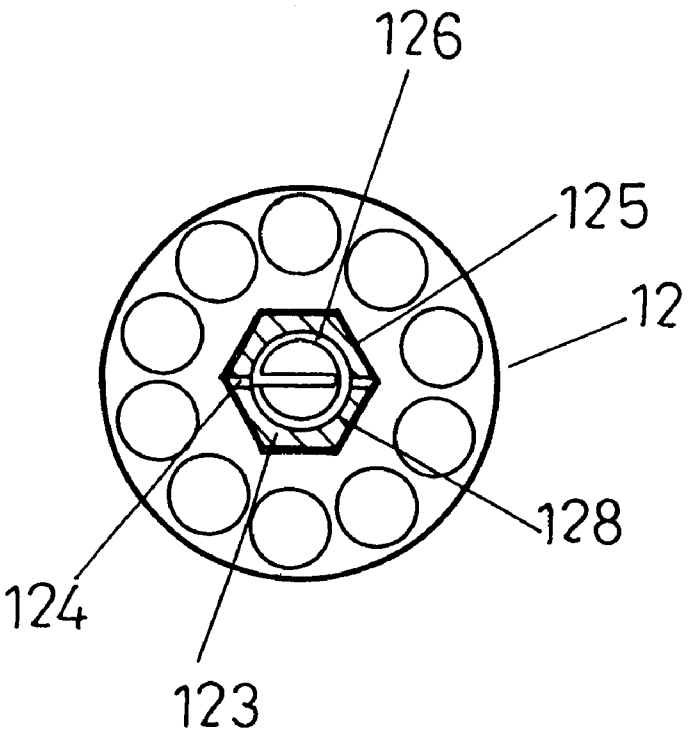
FIG. 6 is a view similar to FIG. 3, illustrating operation of the tilt cord controller.
Figure 5:
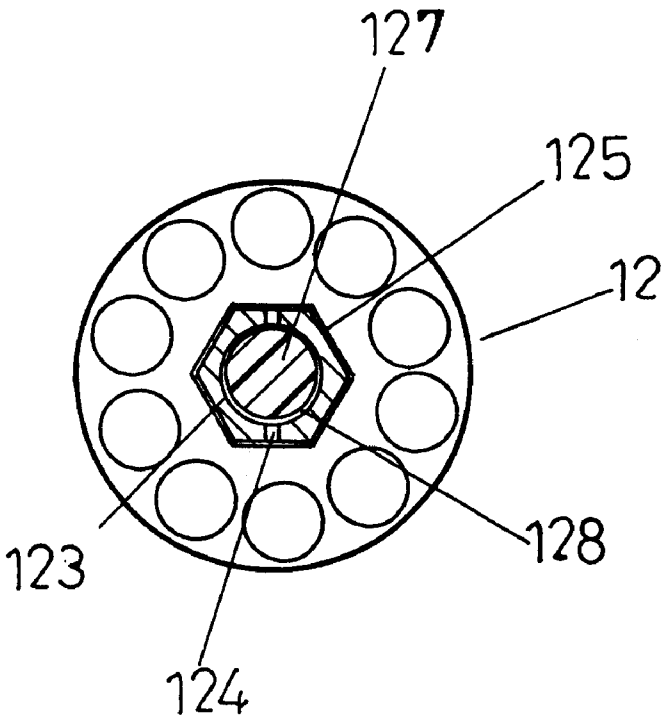
FIG. 5 is a side view, partly sectioned, similar to FIG. 3, illustrating an alternative embodiment of the invention.

FIGS. 5 and 6 illustrates a modified embodiment of the bumping member, wherein the spring is replaced by a rubber-made bumping member 127 with proper resiliency.

According to the above description, it is appreciated that damage to the transmission elements used in the venetian blinds is prevented by means of provision of the slit 124 in the axle 121.

Although the invention has been explained in relation to its preferred embodiment, it is to be understood that many other possible modifications and variations can be made without departing from the spirit and scope of the invention as hereinafter claimed.

What is claimed is:

1. A tilt cord controller comprising:

a casing;

a rotating member rotatably mounted in the casing;

an axle including a first end with an end face and a second end, the second end of the axle being securely engaged with the rotating member to rotate therewith, the end face of the first end of the axle including a slit such that the first end of the axle is compressible inward, the end face of the first end of the axle further including a receptacle;

a bumping member mounted in the receptacle of the first end of the axle;

a pulley mounted around the first end of the axle to rotate therewith; and a tilt cord mound around the pulley.

2. The tilt cord controller as claimed in claim 1, wherein the first end and the second end of the axle have different diameters to form a step therebetween.

3. The tilt cord controller as claimed in claim 1, wherein the bumping member is a spring.

4. The tilt cord controller as claimed in claim 1, wherein the bumping member is made from rubber.

* * * * *